US011016414B2

(12) United States Patent
Morita

(10) Patent No.: US 11,016,414 B2
(45) Date of Patent: May 25, 2021

(54) IMAGE FORMING APPARATUS

(71) Applicant: KYOCERA Document Solutions Inc., Osaka (JP)

(72) Inventor: Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/874,375

(22) Filed: May 14, 2020

(65) Prior Publication Data

US 2020/0363753 A1 Nov. 19, 2020

(30) Foreign Application Priority Data

May 15, 2019 (JP) ..... JP2019-092133

(51) Int. Cl.
*G03G 15/08* (2006.01)
*G03G 21/16* (2006.01)

(52) U.S. Cl.
CPC ..... *G03G 15/0886* (2013.01); *G03G 21/1647* (2013.01); *G03G 21/1676* (2013.01)

(58) Field of Classification Search
CPC ..... G03G 15/0877; G03G 15/0886; G03G 21/1832; G03G 2215/0668; G03G 2215/067
USPC ..... 399/111, 119, 120, 258–263
See application file for complete search history.

(56) References Cited

U.S. PATENT DOCUMENTS 8,867,966 B2 * 10/2014 Acosta ..... G03G 21/1642 399/258
10,126,681 B2 * 11/2018 Nishiyama ..... G03G 15/0877

FOREIGN PATENT DOCUMENTS

JP 2009-080477 A 4/2009

* cited by examiner

*Primary Examiner* — Hoan H Tran
(74) *Attorney, Agent, or Firm* — Studebaker & Brackett PC

(57) ABSTRACT

An image forming apparatus includes a toner container and an apparatus main body. The toner container contains a toner. To the apparatus main body, the toner container is attached in a detachable manner. The toner container includes a container main body and a shutter. The container main body has a toner discharge port. The shutter is rotatable between a close position where the shutter closes the toner discharge port and an open position where the shutter opens the toner discharge port. The apparatus main body includes a driving source and a connection mechanism connectable the driving source to the shutter. When the driving source is driven in a state where the connection mechanism connects the driving source to the shutter, a driving force of the driving source is transmitted to the shutter via the connection mechanism, and the shutter is rotated from the close position to the open position.

13 Claims, 10 Drawing Sheets

IMAGE FORMING APPARATUS

INCORPORATION BY REFERENCE

This application is based on and claims the benefit of priority from Japanese patent application No. 2019-092133 filed on May 15, 2019, which is incorporated by reference in its entirety.

BACKGROUND

The present disclosure relates to an electrophotographic type image forming apparatus.

An electrophotographic type image forming apparatus performs a development processing by supplying a toner from a development device to an electrostatic latent image formed on a surface of an image carrier such as a photosensitive drum. The toner used for the development processing is replenished to the development device from a toner container. The toner container is attached to an apparatus main body of the image forming apparatus in a detachable manner, and is detached from the apparatus main body when the toner is used up and then replaced with new one.

For example, the toner container includes a container main body having a toner discharge port, a shutter opening and closing the toner discharge port and a lever connected to the shutter.

By the way, at a shipping of the image forming apparatus, the toner container and the apparatus main body are sometimes packaged together with the toner container attached to the apparatus main body. In such a case, in order to prevent leakage of the toner through the toner discharge port, the image forming apparatus is shipped with the toner discharge port closed with the shutter. Then, at the first use of the image forming apparatus, an operator, such as a user, operates the lever to move the shutter from a position where the shutter closes the toner discharge port to a position where the shutter opens the toner discharge port. Thereby, an amount of the user's work at the first use of the image forming apparatus is increased.

SUMMARY

In accordance with an aspect of the present disclosure, an image forming apparatus includes a toner container and an apparatus main body. The toner container contains a toner. To the apparatus main body, the toner container is attached in a detachable manner. The toner container includes a container main body and a shutter. The container main body has a toner discharge port. The shutter is rotatable between a close position where the shutter closes the toner discharge port and an open position where the shutter opens the toner discharge port. The apparatus main body includes a driving source and a connection mechanism connectable the driving source to the shutter. When the driving source is driven in a state where the connection mechanism connects the driving source to the shutter, a driving force of the driving source is transmitted to the shutter via the connection mechanism, and the shutter is rotated from the close position to the open position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus 1 according to one embodiment of the present disclosure will be described with reference to the drawings. Arrows Fr, Rr, U, Lo, L and R marked in each figure respectively show a front side, a rear side, an upper side, a lower side, a left side and a right side of the image forming apparatus 1.

Firstly, an entire structure of the image forming apparatus 1 will be described. The image forming apparatus 1 is a color printer, for example.

Figure 1:
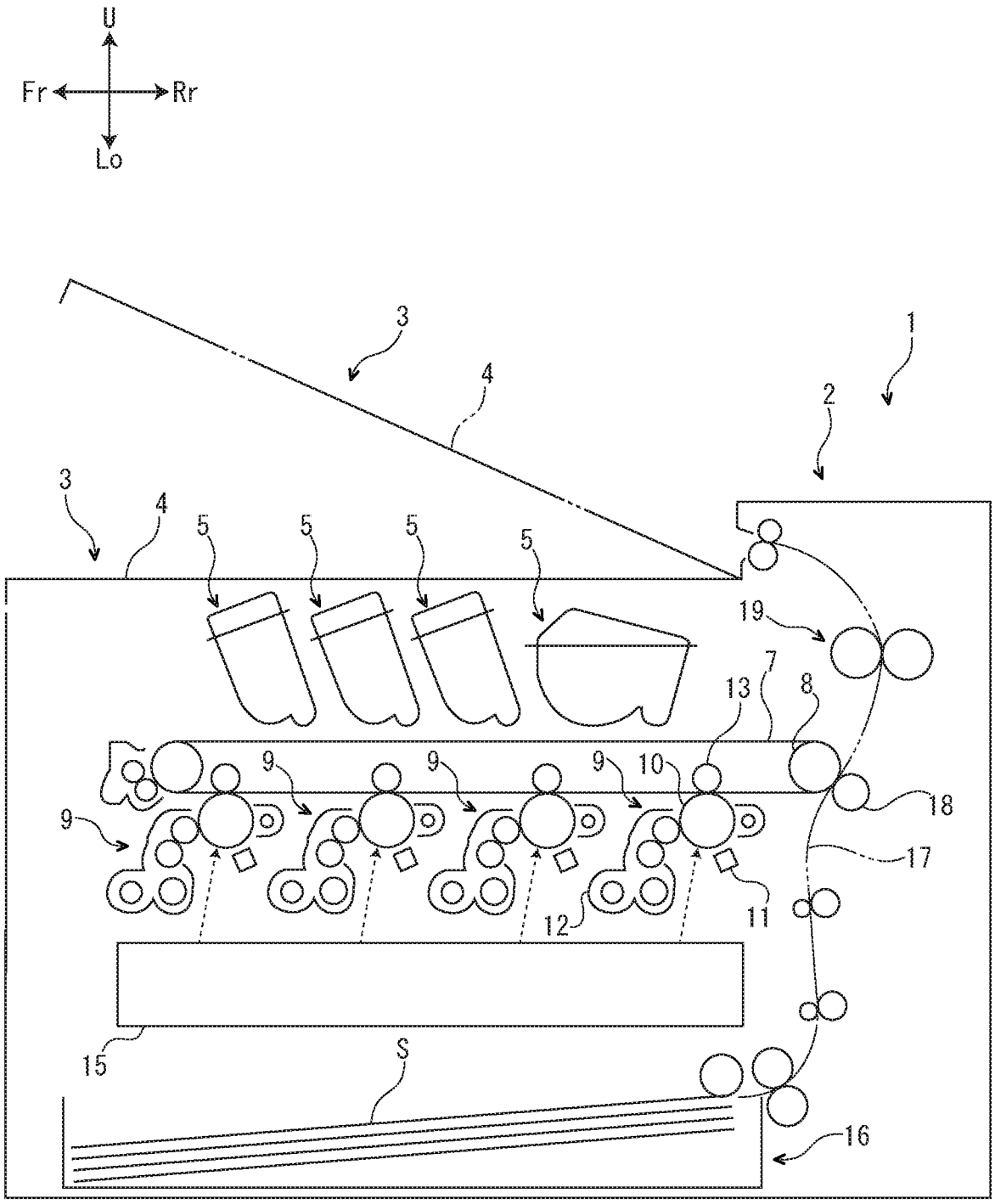
FIG. 1 is a side view schematically showing an image forming apparatus according to one embodiment of the present disclosure.

With reference to FIG. 1, the image forming apparatus 1 includes a box-like shaped apparatus main body 2. In the upper end portion of the apparatus main body 2, an openable and closable top cover 3 is provided. On the upper face of the top cover 3, a discharge tray 4 is provided. In the upper portion of the apparatus main body 2, four toner containers 5 are attached below the top cover 3 in a detachable manner. By opening the top cover 3, the toner containers 5 can be detached from the apparatus main body 2. The four toner containers 5 contain toners (developers) of different colors.

In the center portion of the apparatus main body 2, an intermediate transferring belt 7 is provided. The rear end portion of the intermediate transferring belt 7 is wound around a driving roller 8. In the center portion of the apparatus main body 2, four image forming parts 9 are provided below the intermediate transferring belt 7. Each image forming part 9 includes a photosensitive drum 10 (an example of an image carrier), a charging device 11, a development device 12 and a primary transferring roller 13.

In the lower portion of the apparatus main body 2, an exposure device 15 is provided. In the lower end portion of the apparatus main body 2, a sheet feeding cassette 16 is stored. The sheet feeding cassette 16 stores a sheet S.

In the rear portion of the apparatus main body 2, a sheet conveyance path 17 is formed from the sheet feeding cassette 16 to the discharge tray 4. In the midstream portion of the sheet conveyance path 17, a secondary transferring roller 18 is provided. In the downstream portion of the sheet conveyance path 17, a fixing device 19 is provided.

Next, a printing operation of the image forming apparatus 1 will be described.

When an instruction for printing operation is input to the image forming apparatus 1, each image forming part 9 performs the following image forming operation. Firstly, the charging device 11 charges the surface of the photosensitive drum 10. Next, the exposure device 15 emits light (refer to the dotted line arrow in FIG. 1) to form an electrostatic latent image on the surface of the photosensitive drum 10. Then, the development device 12 develops the electrostatic latent image on the surface of the photosensitive drum 10. Thereby, a toner image is carried on the surface of the photosensitive drum 10. The toner image is primarily transferred from the surface of the photosensitive drum 10 to the surface of the intermediate transferring belt 7 by the primary transferring roller 13.

On the other hand, the sheet S fed from the sheet feeding cassette 16 is conveyed downstream along the sheet conveyance path 17, and enters a nip area between the intermediate transferring belt 7 and the secondary transferring roller 18. The secondary transferring roller 18 secondarily transfers the toner image from the surface of the transferring belt 7 to the sheet S. The sheet S to which the toner image is secondarily transferred enters the fixing device 19. The fixing device 19 fixes the toner image on the sheet S. The sheet S on which the toner image is fixed is discharged on the discharge tray 4.

Next, each toner container 5 will be further described.

Although the image forming apparatus 1 includes the four toner containers 5 as described above, the toner containers 5 have the same structure expect that the rearmost disposed toner container 5 has a capacity larger than the remaining toner containers 5. Then, one toner container 5 will be described, and the description of the remaining three toner containers 5 is omitted.

Figure 2:
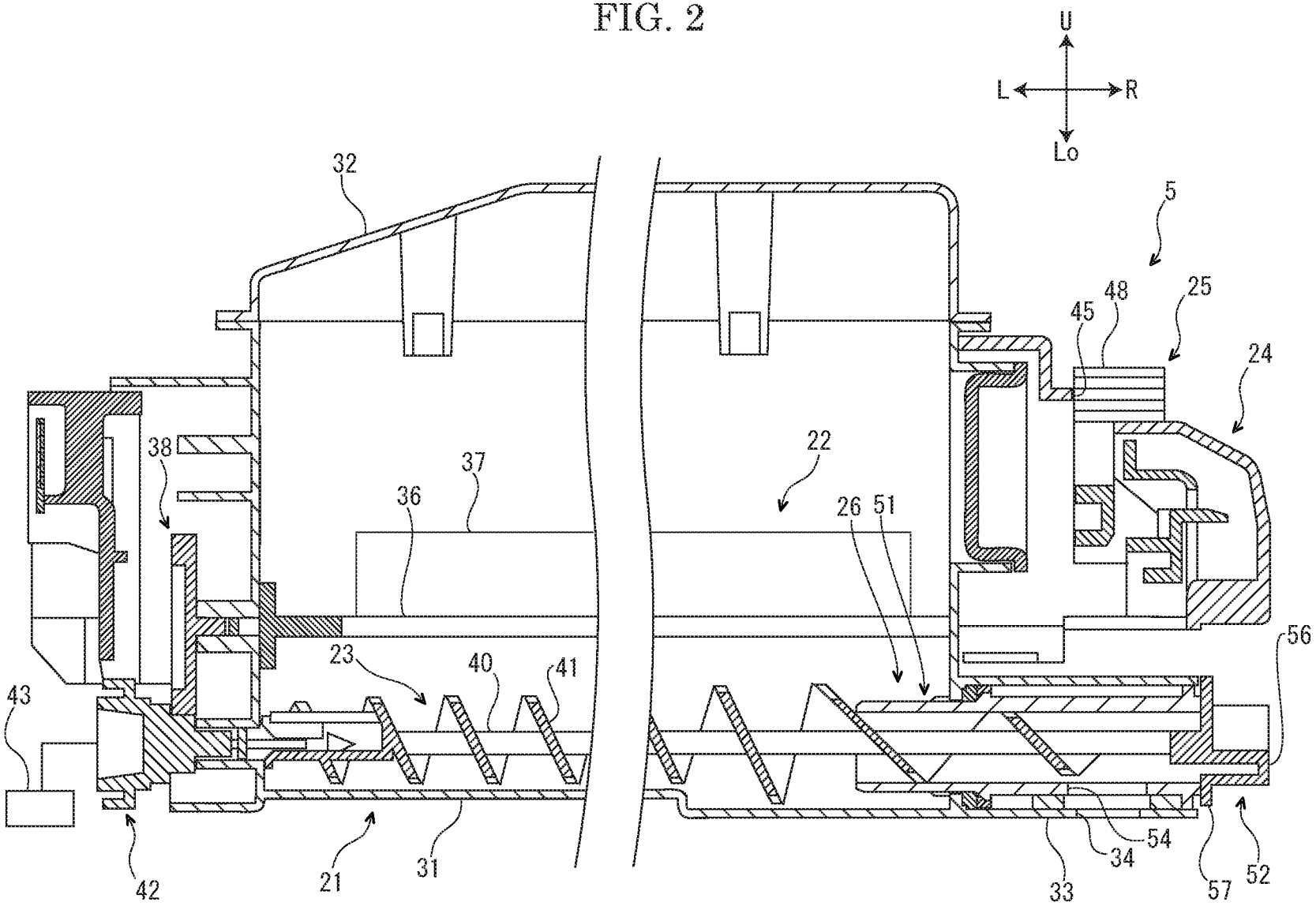
FIG. 2 is a sectional view showing a toner container according to the embodiment of the present disclosure.

With reference to FIG. 2, the toner container 5 includes a container main body 21, an agitation paddle 22, a conveyance screw 23, a side cover 24, an operation member 25 and a shutter 26. Hereinafter, the components of the toner container 5 will be described in the order.

Figure 3:
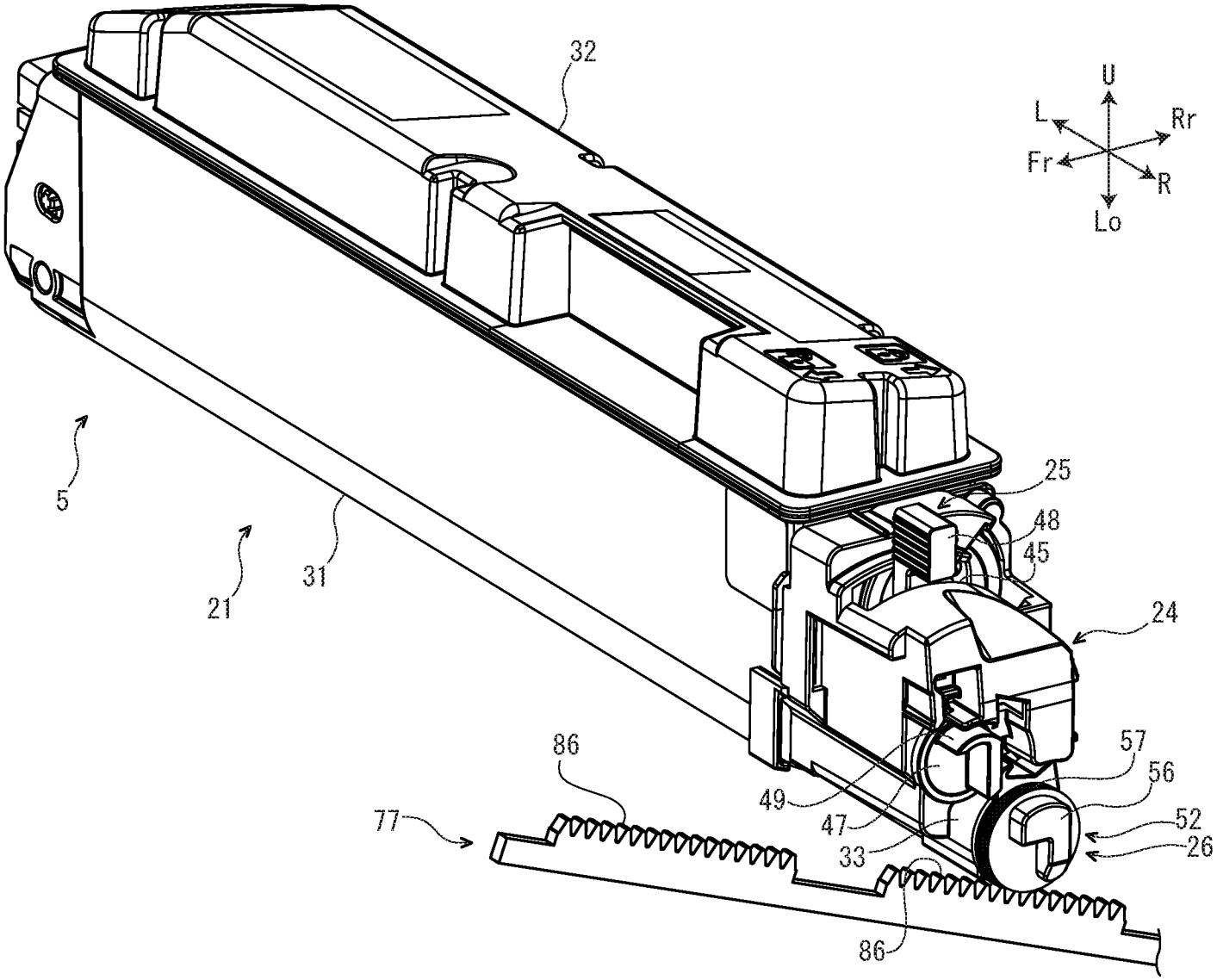
FIG. 3 is a perspective view showing a state where a shutter is in a close position, an operation member is in a first operation position and a moving piece is in a connection position, in the image forming apparatus according to the embodiment of the present disclosure.
Figure 4:
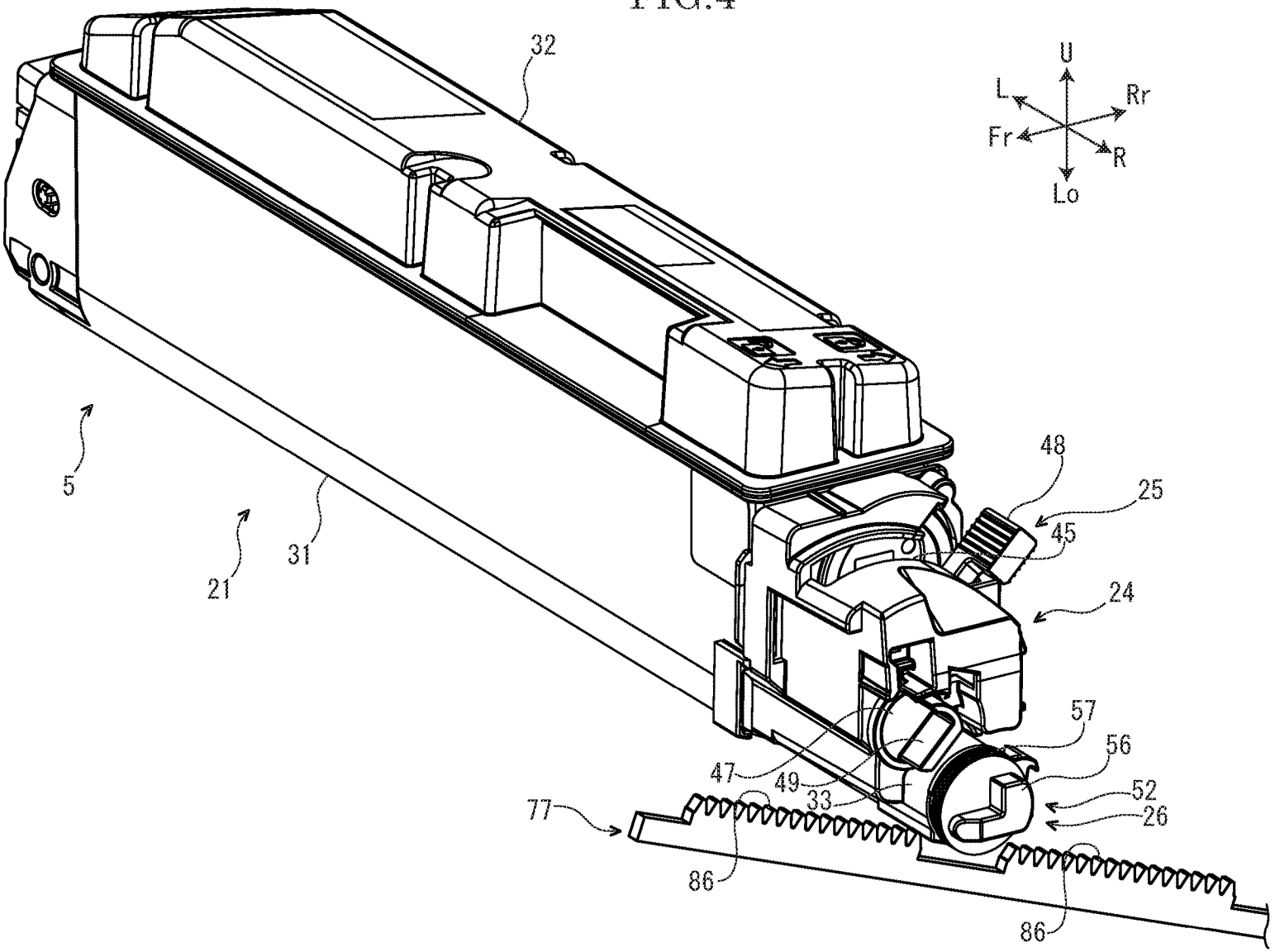
FIG. 4 is a perspective view showing a state where the shutter is in an open position, the operation member is in a second operation position and the moving piece is in a release position, in the image forming apparatus according to the embodiment of the present disclosure.

With reference to FIG. 2 to FIG. 4, the container main body 21 of the toner container 5 has a shape long in the left-and-right direction. The container main body 21 contains the toner.

The container main body 21 has a storage part 31, a lid part 32 covering the upper face of the storage part 31 and a duct part 33 protruding rightward from the right end portion of the storage part 31. The storage part 31 is formed into a box-like shape whose upper face is opened. The lid part 32 is provided separately from the storage part 31, and fixed on the upper end portion of the storage part 31. The lid part 32 is formed into a box-like shape whose lower face is opened. The duct part 33 is formed integrally with the storage part 31, and has a cylindrical shape extending in the left-and-right direction. On the lower face of the duct part 33, a toner discharge port 34 is provided.

With reference to FIG. 2, the agitation paddle 22 of the toner container 5 is stored in the storage part 31 of the container main body 21. The agitation paddle 22 has a frame body 36 and a film 37 mounted to the frame body 36. The frame body 36 extends along the left-and-right direction. An agitation gear 38 is fixed to the left end portion of the frame body 36. The agitation gear 38 is exposed to an outside of the container main body 21.

With reference to FIG. 2, the left portion and the center portion of the conveyance screw 23 of the toner container 5 are stored in the storage part 31 of the container main body 21. The right portion of the conveyance screw 23 is stored in the duct part 33 of the container main body 21. The conveyance screw 23 has a rotational shaft 40 and a spiral 41 protruding from the outer circumferential face of the rotational shaft 40. The rotational shaft 40 extends along the left-and-right direction. A conveyance gear 42 is fixed to the left end portion of the rotational shaft 40. The conveyance gear 42 is exposed to an outside of the container main body 21, and meshed with the agitation gear 38. The conveyance gear 42 is connected to a driving part 43 containing a motor.

With reference to FIG. 2 to FIG. 4, the side cover 24 of the toner container 5 is exposed to an outside of the container main body 21. The side cover 24 covers the right face of the storage part 31 of the container main body 21. In the upper portion of the side cover 24, a window 45 is provided.

With reference to FIG. 2 to FIG. 4, the operation member 25 of the toner container 5 is exposed to an outside of the container main body 21. The operation member 25 is disposed on a right side of the storage part 31 of the container main body 21. The operation member 25 has a fulcrum part 47 and a lever part 48 extending upward from the fulcrum part 47 (only the upper end portion of the lever part 48 is shown in FIG. 2 to FIG. 4). The operation member 25 is rotatable around the fulcrum part 47 between a first operation position (refer to FIG. 3) and a second operation position (refer to FIG. 4). On the right face (the outer face) of the fulcrum part 47, a driving coupling 49 is provided. The upper end portion of the lever part 48 is exposed to an outside through the window 45 of the side cover 24.

With reference to FIG. 2 to FIG. 4, the shutter 26 of the toner container 5 is attached to the duct part 33 of the container main body 21. The shutter 26 has a shutter main body 51 and a cap 52 fixed to the shutter main body 51.

The shutter main body 51 of the shutter 26 has a cylindrical shape extending along the left-and-right direction. The shutter main body 51 is inserted into the duct part 33 of the container main body 21. The shutter main body 51 has a communication port 54.

The cap 52 of the shutter 26 has a circular plate-like shape. The cap 52 is provided separately from the shutter main body 51, and closes the right end portion of the shutter main body 51. On the right face (the outer face) of the cap 52, a driven coupling 56 is provided. On the outer circumferential face of the cap 52, a driven gear 57 is provided.

The shutter 26 is rotatable between a close position (refer to FIG. 3) and an open position (refer to FIG. 2 and FIG. 4). In a state where the shutter 26 is in the close position, the communication port 54 is not communicated with the toner discharge port 34, and the shutter 26 closes the toner discharge port 34. In a state where the shutter 26 is in the open position, the communication port 54 is communicated with the toner discharge port 34, and the shutter 26 opens the toner discharge port 34.

Next, the apparatus main body 2 will be further described.

Figure 5:
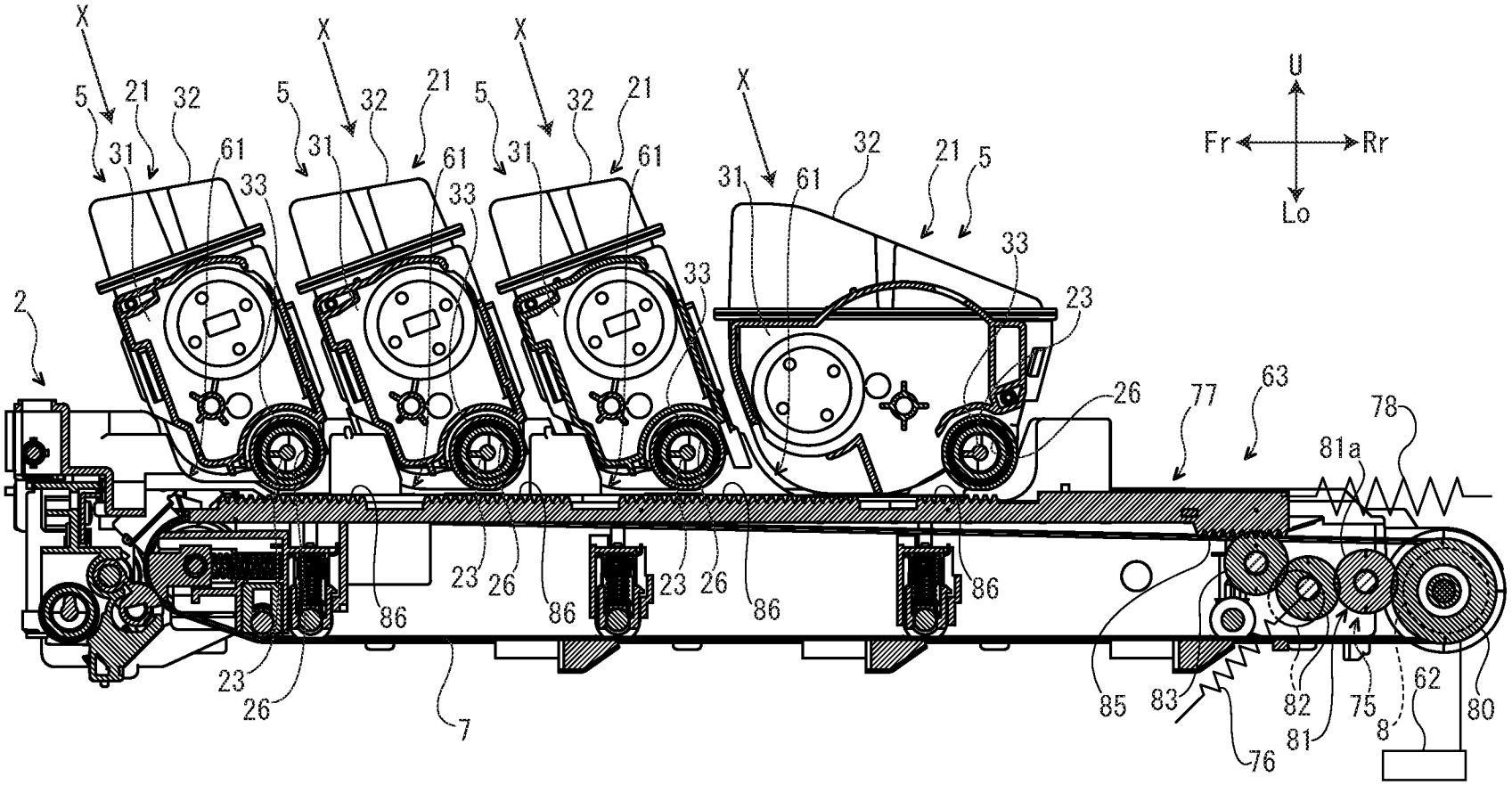
FIG. 5 is a perspective view showing a state where the moving piece is in the connection position, in the image forming apparatus according to the embodiment of the present disclosure.
Figure 6:
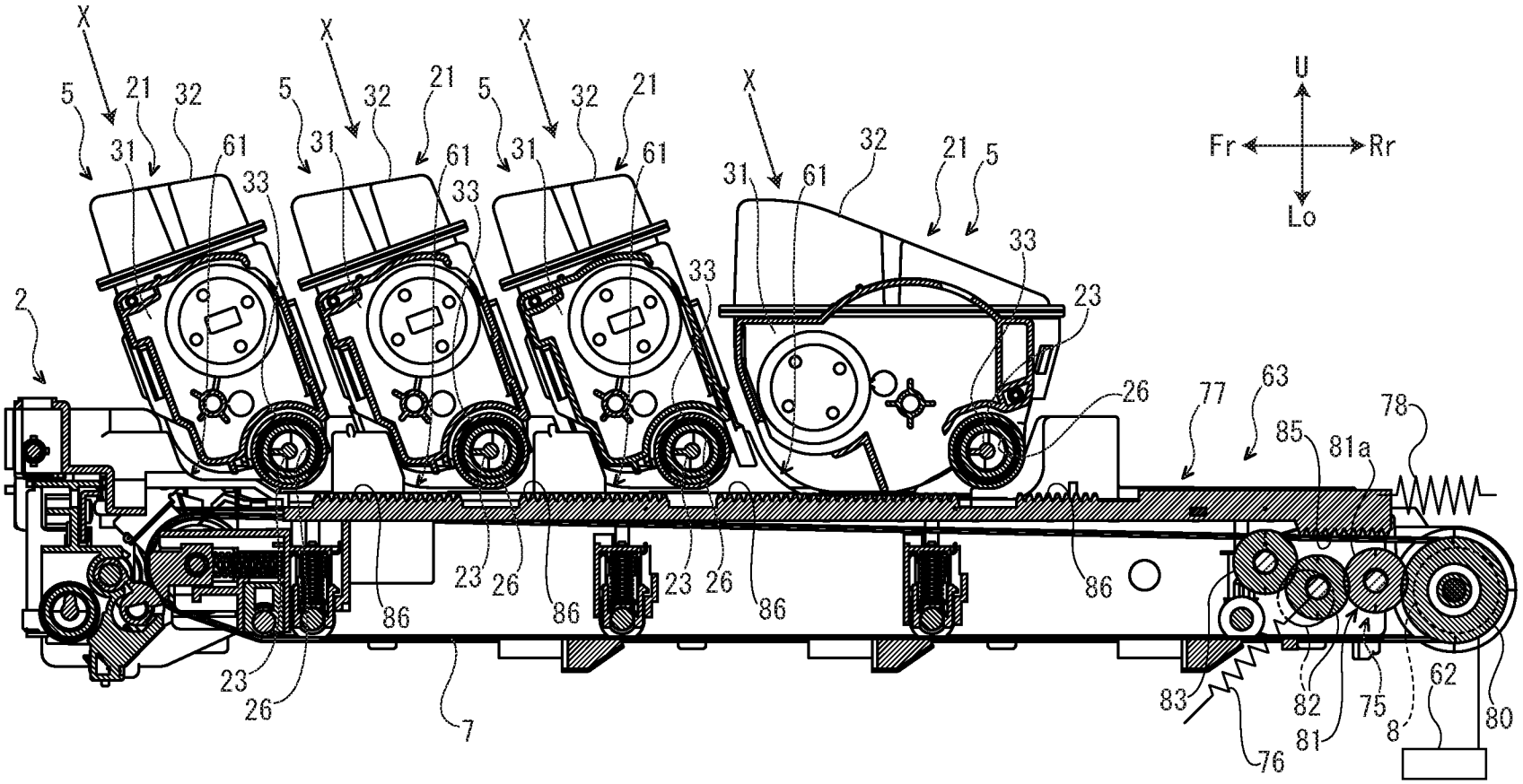
FIG. 6 is a perspective view showing a state where the moving piece is in the release position, in the image forming apparatus according to the embodiment of the present disclosure.
Figure 7:
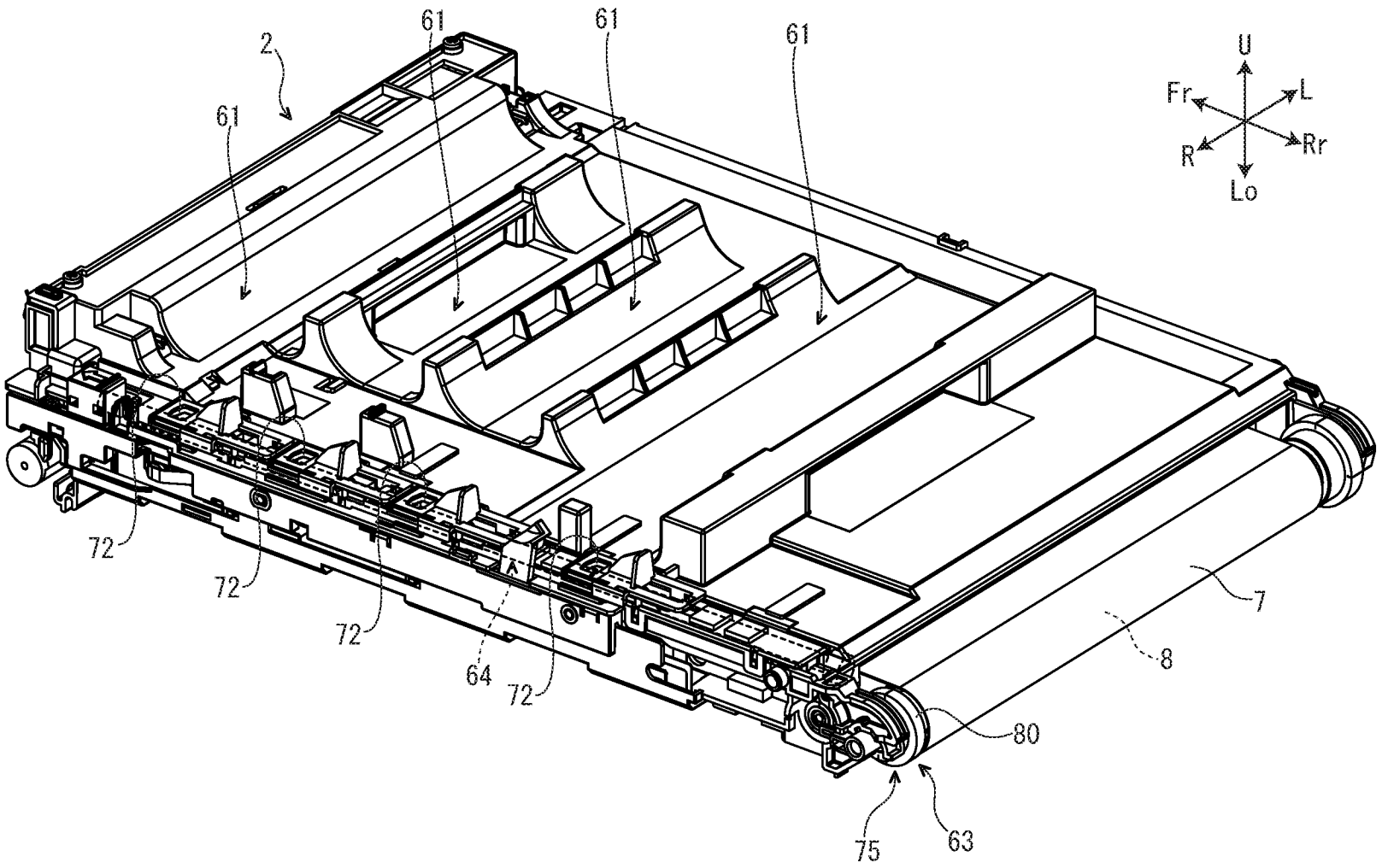
FIG. 7 is a perspective view showing an attachment part and its peripheral portion, in the image forming apparatus according to the embodiment of the present disclosure.

With reference to FIG. 5 to FIG. 7, the apparatus main body 2 includes four attachment parts 61, a driving source 62, a connection mechanism 63 and a conveyance member 64. Hereinafter, the components of the apparatus main body 2 will be described in the order.

With reference to FIG. 5 to FIG. 7, each attachment part 61 of the apparatus main body 2 extends along the left-and-right direction. To each attachment part 61, the corresponding toner container 5 is attached in a detachable manner. An arrow X marked in FIG. 5 and FIG. 6 shows an attachment direction of each toner container 5 to the corresponding attachment part 61.

Figure 8:
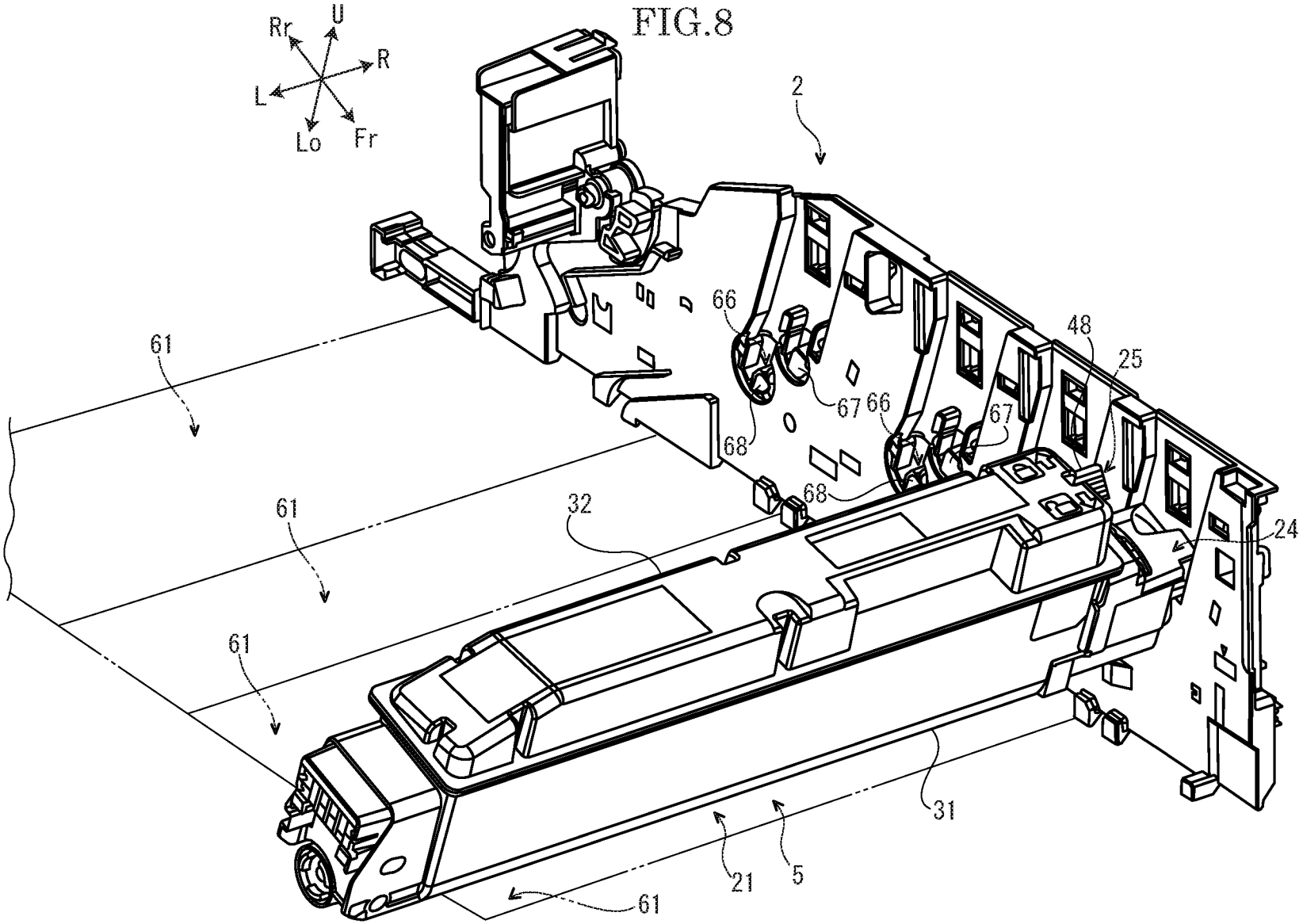
FIG. 8 is a perspective view showing the toner container and a transmission mechanism, in the image forming apparatus according to the embodiment of the present disclosure.

With reference to FIG. 8, on a right side of each attachment part 61, a transmission mechanism 66 is provided. Each transmission mechanism 66 includes a first transmission coupling 67 and a second transmission coupling 68. The first transmission coupling 67 and the second transmission coupling 68 are connected via a gear train (not shown). The first transmission coupling 67 is engaged with the driving coupling 49 (refer to FIG. 3 and FIG. 4) of the operation member 25 of each toner container 5, and the second transmission coupling 68 is engaged with the driven coupling 56 (refer to FIG. 3 and FIG. 4) of the shutter 26 of each toner container 5. As described above, the transmission mechanism 66 connects the operation member 25 to the shutter 26.

Figure 9:
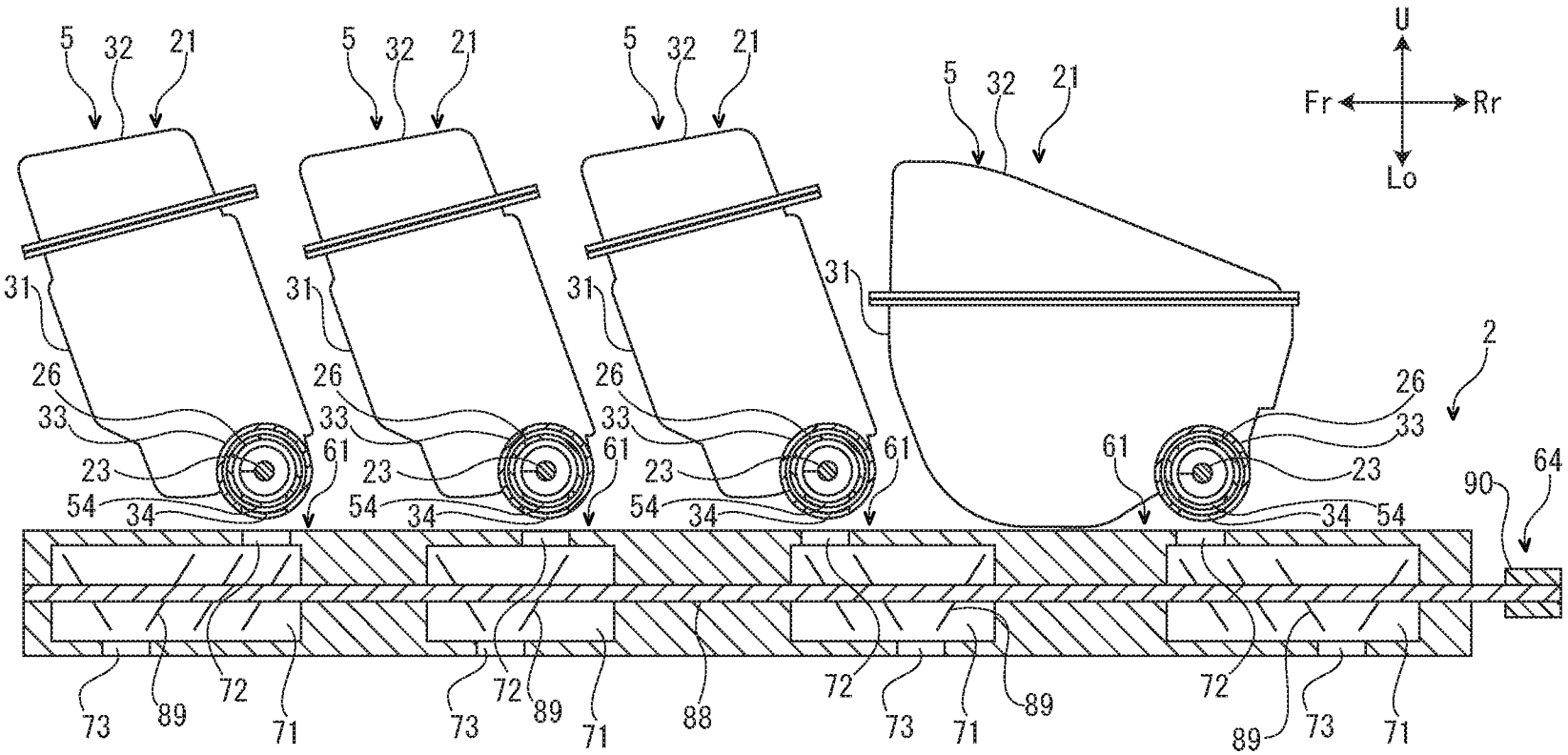
FIG. 9 is a sectional view showing the toner container and the attachment portion, in the image forming apparatus according to the embodiment of the present disclosure.

With reference to FIG. 9, in the lower portion of each attachment part 61, a toner conveyance path 71 is provided along the front-and-rear direction. In one side portion of each toner conveyance path 71 in the front-and-rear direction, a toner input port 72 is provided. The toner input port 72 is opened to each attachment part 61. In the other side portion of each toner conveyance path 71 in the front-and-rear direction, a toner output port 73 is provided. The toner output port 73 is connected to the development device 12 (refer to FIG. 1) of each image forming part 9.

With reference to FIG. 5 and FIG. 6, the driving source 62 of the apparatus main body 2 contains a motor. The driving source 62 is schematically shown in FIG. 5 and FIG. 6, and the position of the driving source 62 in FIG. 5 and FIG. 6 is not necessarily the same as the actual position of the driving source 62. The driving source 62 is not shown except for FIG. 5 and FIG. 6.

With reference to FIG. 5 and FIG. 6, the connection mechanism 63 of the apparatus main body 2 includes a gear train 75, a biasing body 76, a moving piece 77 and a biasing member 78.

Figure 10:
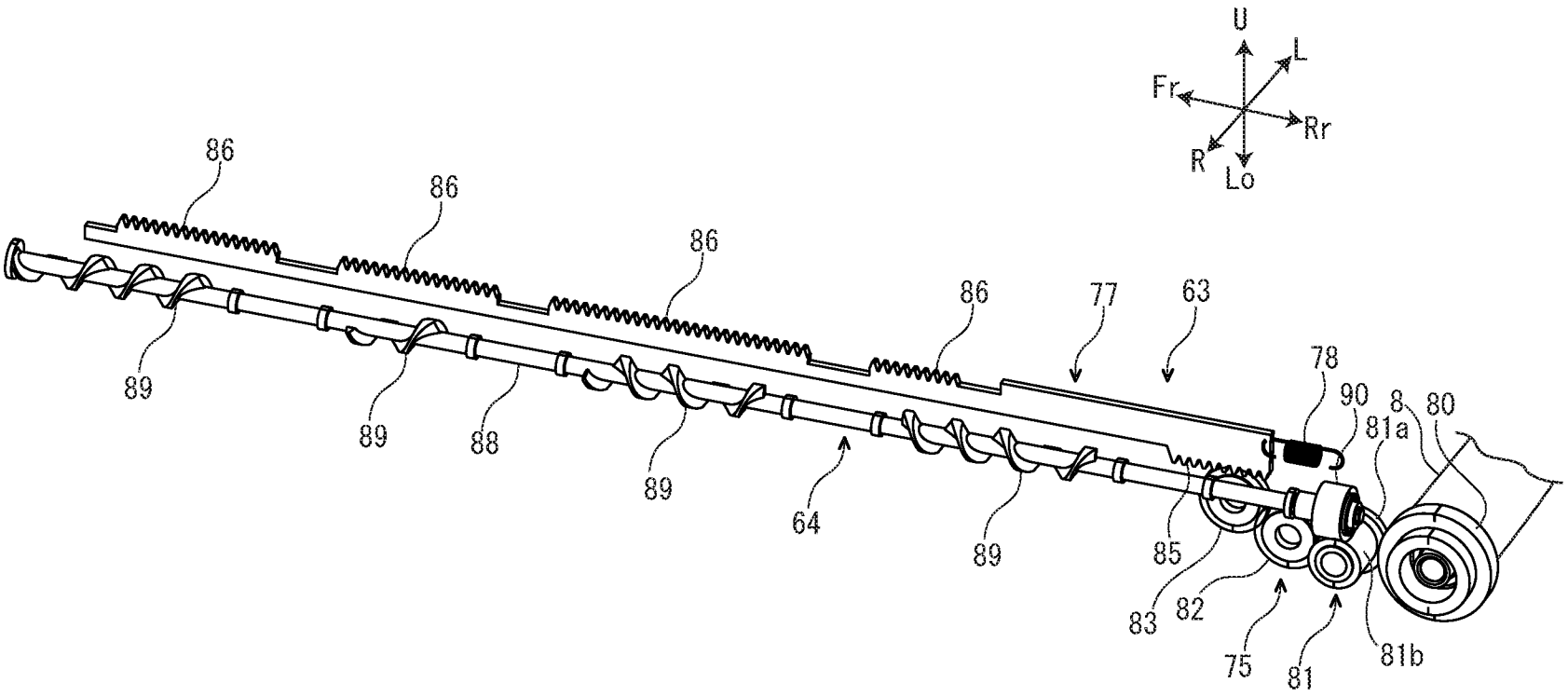
FIG. 10 is a perspective view showing a driving roller, a connection mechanism and a conveyance member, in the image forming apparatus according to the embodiment of the present disclosure.

With reference to FIG. 5, FIG. 6 and FIG. 10, the gear train 75 of the connection mechanism 63 includes a driving gear 80, an idle gear 81 disposed in front of the driving gear 80, a movable gear 82 disposed in front of the idle gear 81 and a connection gear 83 disposed in front of the movable gear 82.

The driving gear 80 of the gear train 75 of the connection mechanism 63 is connected to the driving source 62. The driving gear 80 is fixed to the right end portion of the driving roller 8. Then, the driving roller 8 is connected to the connection mechanism 63.

The idle gear 81 of the gear train 75 of the connection mechanism 63 has a large diameter portion 81*a* and a small diameter portion 81*b* having an outer diameter smaller than the large diameter portion 81*a*. The large diameter portion 81*a* is meshed with the driving gear 80.

The movable gear 82 of the gear train 75 of the connection mechanism 63 is rotatable around the connection gear 83 between a first position (refer to the solid line in FIG. 5 and FIG. 6) and a second position (refer to the two-dotted chain line in FIG. 5 and FIG. 6). In a state where the movable gear 82 is in the first position, the movable gear 82 is meshed with the large diameter portion 81*a* of the idle gear 81, and the connection gear 83 is connected to the driving source 62 via the movable gear 82, the idle gear 81 and the driving gear 80. In a state where the movable gear 82 is in the second position, the meshing between the movable gear 82 and the large diameter portion 81*a* of the idle gear 81 is released, and the connection gear 83 and the driving source 62 are disconnected.

The connection gear 83 of the gear train 75 of the connection mechanism 63 is meshed with the movable gear 82 regardless of whether the movable gear 82 is in the first position or the second position.

The biasing body 76 of the connection mechanism 63 contains a coil spring, for example. The biasing body 76 is connected to the movable gear 82 of the gear train 75, and biases the movable gear 82 of the gear train 75 to the first position.

The moving piece 77 of the connection mechanism 63 extends along the front-and-rear direction. On the rear end portion of the lower face of the moving piece 77, a first rack gear 85 is provided. On the upper face of the moving piece 77, four second rack gears 86 are formed at intervals.

The moving piece 77 of the connection mechanism 63 is linearly movable along the front-and-rear direction between a connection position (refer to FIG. 3 and FIG. 5) and a release position (refer to FIG. 4 and FIG. 6). In a state where the moving piece 77 is in the connection position, the first rack gear 85 of the moving piece 77 is meshed with the connection gear 83 of the gear train 75, and each second rack gear 86 of the moving piece 77 is meshed with the driven gear 57 of the shutter 26 of each toner container 5. That is, in the state where the moving piece 77 is in the connection position, the movable piece 77 connects the gear train 75 to the shutter 26 of each toner container 5. In a state where the moving piece 77 is in the release position, the first rack gear 85 of the moving piece 77 is not meshed with the connection gear 83 of the gear train 75, and each second rack gear 86 of the moving piece 77 is not meshed with the driven gear 57 of the shutter 26 of each toner container 5. That is, in the state where the moving piece 77 is in the release position, the moving piece 77 disconnects the gear train 75 and the shutter 26 of each toner container 5.

With reference to FIG. 5 and FIG. 6, the biasing member 78 of the connection mechanism 63 contains a coil spring, for example. The biasing member 78 is connected to the rear end portion of the moving piece 77, and biases the moving piece 77 to the release position.

With reference to FIG. 9 and FIG. 10, the conveyance member 64 of the apparatus main body 2 includes a conveyance shaft 88, four conveyance blades 89 protruding from the outer circumferential face of the conveyance shaft 88 and an input gear 90 fixed to the rear end portion of the conveyance shaft 88. The conveyance shaft 88 extends along the front-and-rear direction. Each conveyance blade 89 has a spiral shape. The conveyance blades 89 are provided at intervals along the front-and-rear direction, and stored in each toner conveyance path 71. The input gear 90 is meshed with the small diameter portion 81*b* of the idle gear 81 of the gear train 75 of the connection mechanism 63. Then, the conveyance member 64 is connected to the connection mechanism 63.

Next, in the image forming apparatus 1 configured in the above described manner, an operation to replenish the toner from each toner container 5 to the development device 12 of the corresponding image forming part 9 (hereinafter, called "a toner replenishment operation") will be described.

When the toner replenishment operation is performed, the driving part 43 is driven. When the driving part 43 is driven, a driving force of the driving part 43 is transmitted to the conveyance gear 42 to rotate the conveyance gear 42. When the conveyance gear 42 is thus rotated, a rotation of the conveyance gear 42 is transmitted to the agitation paddle 22 via the agitation gear 38 to rotate the agitation paddle 22. Then, the toner contained in the container main body 21 is agitated by the agitation paddle 22.

Additionally, when the conveyance gear 42 is rotated in the above manner, the rotation of the conveyance gear 42 is transmitted to the conveyance screw 23 to rotate the conveyance screw 23. Then, the toner contained in the container main body 21 is conveyed along the left-and-right direction by the conveyance screw 23, and then discharged to an outside of the container main body 21 through the toner discharge port 34. The toner discharged the outside of the container main body 21 is introduced in the toner conveyance path 71 through the toner inlet port 72.

Additionally, at the performing of the toner replenishment operation, the driving source 62 is driven. When the driving source 62 is thus driven, a driving force of the driving source 62 is transmitted to the driving gear 80 to rotate the driving gear 80. When the driving gear 80 is thus rotated, a rotation of the driving gear 80 is transmitted to the conveyance member 64 via the idle gear 81 to rotate the conveyance member 64. Then, the toner introduced in the toner conveyance path 71 is conveyed along the front-and-rear direction by the conveyance member 64, and then discharged from the toner conveyance path 71 through the toner outlet port 73. The toner discharged from the toner conveyance path 71 is replenished to each development device 12 of the image forming part 9.

When the driving gear 80 is rotated as described above, the rotation of the driving gear 80 is transmitted to the driving roller 8 to rotate the driving roller 8. Then, the driving roller 8 rotates the intermediate transferring belt 7.

Next, an operation of the shutter 26, the moving piece 77 and the operation member 25 will be described.

When the image forming apparatus 1 is shipped, the toner container 5 and the apparatus main body 2 are packaged together with the toner container 5 attached to the attachment part 61 of the apparatus main body 2. Thereby, at the shipping of the image forming apparatus 1 (before the starting of the use of the toner container 5), in order to prevent leakage of the toner through the toner discharge port 34, the shutter 26 is in the close position (refer to FIG. 3). Then, until the shipped image forming apparatus 1 is used, the shutter 26 is kept in the close position. Additionally, until the shipped image forming apparatus 1 is used, the moving piece 77 is kept in the connection position (refer to FIG. 3 and FIG. 5) and the operation member 25 is kept in the first operation position (refer to FIG. 3).

At the first use of the image forming apparatus 1 (at the first use of the toner container 5), when the driving source 62 is driven, the driving force of the driving source 62 is transmitted to the driving gear 80 to rotate the driving gear 80. When the driving gear 80 is thus rotated, the rotation of the driving gear 80 is transmitted to the connection gear 83 via the idle gear 81 and the movable gear 82 to rotate the connection gear 83. When the connection gear 83 is thus rotated, the rotation of the connection gear 83 is changed to a linear movement of the moving piece 77, and the moving piece 77 is linearly moved from the connection position (refer to FIG. 3 and FIG. 5) to the release position (refer to FIG. 4 and FIG. 6).

When the moving piece 77 is linearly moved from the connection position to the release position, the linear movement of the moving piece 77 is changed to the rotation of the shutter 26, and the shutter 26 is rotated from the close position (refer to FIG. 3) to the open position (refer to FIG. 2 and FIG. 4). When the shutter 26 is thus rotated from the close position to the open position, the rotation of the shutter 26 is transmitted to the operation member 25 via the transmission mechanism 66, and the operation member 25 is rotated from the first operation position (refer to FIG. 3) to the second operation position (refer to FIG. 4).

On the other hand, at the second and subsequent uses of the image forming apparatus 1, when an operator, such as a user, rotates the operation member 25 from the second operation position to the first operation position, the rotation is transmitted to the shutter 26 via the transmission mechanism 66, and the shutter 26 is rotated from the open position to the close position. Additionally, at the second and subsequent uses of the image forming apparatus 1, when the operator rotates the operation member 25 from the first operation position to the second operation position, the rotation is transmitted to the shutter 26 via the transmission mechanism 66, and the shutter 26 is rotated from the close position to the open position.

At the second and subsequent uses of the image forming apparatus 1, the moving piece 77 is kept in the release position by the biasing force of the biasing member 78. That is, at the second and subsequent uses of the image forming apparatus 1, the shutter 26 and the moving piece 77 are disconnected. Thereby, even if the shutter 26 is rotated as described above, the rotation of the shutter 26 is not changed to the linear movement of the moving piece 77, and the moving piece 77 is stopped in the release position.

On the other hand, at inspection of the image forming apparatus 1 at a factory, a case where the moving piece 77 is returned from the release position to the connection position may be occur. In such a case, the operator rotates the movable gear 82 from the first position (refer to the solid line in FIG. 5 and FIG. 6) to the second position (refer to the two-dotted line in FIG. 5 and FIG. 6) by his one hand, and the connection gear 83 and the driving source 62 are disconnected. With keeping the situation, the operator moves the moving piece 77 from the release position to the connection position linearly by his other hand. Next, the operator releases his one hand from the movable gear 82. Then, by the biasing force of the biasing body 76, the movable gear 82 is rotated from the second position to the first position.

In the present embodiment, at the first use of the image forming apparatus 1, when the driving source 62 is driven with the connection mechanism 63 connecting the driving source 62 to the shutter 26, the driving force of the driving source 62 is transmitted to the shutter 26 via the connection mechanism 63, and the shutter 26 is rotated from the close position to the open position. By applying such a configuration, at the first use of the image forming apparatus 1, if the operator does not operate the operation member 25, the shutter 26 is automatically rotated from the close position to the open position. Then, it becomes possible to decrease an amount of the operator's work at the first use of the image forming apparatus 1.

Additionally, when the driving source 62 is driven with the moving piece 77 connecting the gear train 75 to the shutter 26, the driving force of the driving source 62 is transmitted to the shutter 26 via the gear train 75 and the moving piece 77, and the shutter 26 is rotated from the close position to the open position. By applying such a configuration, it becomes possible to rotate the shutter 26 from the close position to the open position by using a simple structure.

At the second and subsequent uses of the image forming apparatus 1, even if the moving piece 77 keeps the connecting between the gear train 75 and the shutter 26, the operation member 25 may be connected to the driving source 62 via the transmission mechanism 66, the shutter 26, the moving piece 77 and the gear train 75, and it may become impossible to rotate the operation member 25.

Then, in the present embodiment, when the driving source 62 is driven in the state where the moving piece 77 is in the connection position, the driving force of the driving source 62 is transmitted to the moving piece 77 via the gear train 75, and the moving piece 77 is linearly moved from the connection position to the release position. By applying such a configuration, at the second and subsequent uses of the image forming apparatus 1, it becomes possible to disconnect the operation member 25 and the driving source 62 and to rotate the operation member 25 with a light force.

The connection mechanism 63 includes the biasing member 78 biasing the moving piece 77 to the release position. By applying such a configuration, at the second and subsequent uses of the image forming apparatus 1, it becomes possible to inhibit the moving piece 77 from being returned from the release position to the connection position accidentally.

The moving piece 77 includes the first rack gear 85 meshed with the connection gear 83 of the gear train 75 and the second rack gear 86 meshed with the driven gear 57 of the shutter 26. By applying such a configuration, it becomes possible to change the rotation of the gear train 75 to the linear movement of moving piece 77 and to change the linear movement of the moving piece 77 to the rotation of the shutter 26 by using a simple structure.

The moving piece 77 has the four second rack gears 86 meshed with the driven gears 57 of the shutters 26 of the four toner containers 5. By applying such a configuration, it becomes possible to automatically rotate the shutters 26 of all the toner containers 5 from the close position to the open position at the same time.

The gear train 75 includes the movable gear 82 rotatable between the first position where it connects the connection gear 83 to the driving source 62 and the second position where it disconnects the connection gear 83 and the driving source 62. By applying such a configuration, at inspection of the image forming apparatus 1 at a factory, it becomes possible to return the moving piece 77 from the release position to the connection position as needed so that the convenience of the image forming apparatus 1 is improved.

The connection mechanism 63 includes the biasing body 76 biasing the movable gear 82 to the first position. By applying such a configuration, it becomes possible to inhibit the movable gear 82 from being rotated from the first position to the second position accidentally. Thereby, at the first use of the image forming apparatus 1, it becomes possible to transmit the driving force of the driving source 62 to the moving piece 77 via the gear train 75 surely.

When the operation member 25 is rotated between the first operation position and the second operation position in the state where the connection mechanism 63 disconnects the driving source 62 and the shutter 26, the rotation of the operation member 25 is transmitted to the shutter 26, and the shutter 26 is rotated between the close position and the open position. By applying such a configuration, at the second and subsequent uses of the image forming apparatus 1, it becomes possible to rotate the shutter 26 depending on the operation of the operation member 25 so that the convenience of the image forming apparatus 1 is improved.

When the driving source 62 is driven, the driving force of the driving source 62 is transmitted to the conveyance member 64 via the connection mechanism 63, and the conveyance member 64 is rotated. By applying such a configuration, it becomes possible to use the driving source 62 for the rotation of the conveyance member 64 and for the rotation of the shutter 26 from the close position to the open position at the first use of the image forming apparatus 1.

When the driving source 62 is driven, the driving force of the driving source 62 is transmitted to the driving roller 8 via the connection mechanism 63, and the driving roller 8 is rotated. By applying such a configuration, it becomes possible to use the driving source 62 for the rotation of the driving roller 8 and for the rotation of the shutter 26 from the close position to the open position at the first use of the image forming apparatus 1.

In the present embodiment, the driving source 62 for the rotations of the conveyance member 64 and the driving roller 8 is used to rotate the shutter 26 from the close position to the open position at the first use of the image forming apparatus 1. On the other hand, in the other embodiments, the driving source 62 for the rotation of any one of the conveyance member 64 and the driving roller 8 may be used to rotate the shutter 26 from the close position to the open position at the first use of the image forming apparatus 1. In still other embodiments, the driving source 62 to rotate a rotating member (for example, the agitation paddle 22 and the conveyance screw 23) other than the conveyance member 64 and the driving roller 8 may be used to rotate the shutter 26 from the close position to the open position at the first use of the image forming apparatus 1.

In the present embodiment, the connection mechanism 63 includes the rotating member (that is, the gear train 75) and the linearly moving member (that is, the moving piece 77). On the other hand, in other embodiments, the connection mechanism 63 may include the rotating member only, or the linearly moving member only.

In the present embodiment, the image forming apparatus 1 is a color printer. On the other hand, in other embodiments, the image forming apparatus 1 may be a copying machine, a facsimile, a multifunctional peripheral (an apparatus containing a printing function, a copying function and a facsimile function totally).

The invention claimed is:

1. An image forming apparatus comprising:

a toner container containing a toner; and an apparatus main body to which the toner container is attached in a detachable manner, wherein the toner container includes:

a container main body having a toner discharge port; and a shutter rotatable between a close position where the shutter closes the toner discharge port and an open position where the shutter opens the toner discharge port, the apparatus main body includes:

a driving source; and a connection mechanism connectable the driving source to the shutter, and the connection mechanism includes:

a gear train connected to the driving source; and a moving piece disposed between the gear train and the shutter and movable linearly between a connection position where the moving piece connects the gear train to the shutter and a release position where the moving piece disconnects the gear train and the shutter, when the driving source is driven in a state where the moving piece is moved to the connection position, the driving force of the driving source is transmitted to the shutter via the gear train and the moving piece, and the shutter is rotated from the close position to the open position.

2. The image forming apparatus according to claim 1, wherein when the driving source is driven in the state where the moving piece is moved to the connection position, the driving force of the driving source is transmitted to the moving piece via the gear train, and the moving piece is linearly moved from the connection position to the release position.

3. The image forming apparatus according to claim 2, wherein the connection mechanism further includes a biasing member biasing the moving piece to the release position.

4. The image forming apparatus according to claim 3, wherein the moving piece is moved to the connection position before a first use of the toner container is started, after the driving source is driven to move the moving piece from the connection position to the release position at the first use of the toner container, the shutter is kept in the open position and the moving piece is kept in the release position.

5. The image forming apparatus according to claim 1, wherein the gear train includes a connection gear, the shutter includes a driven gear, and the moving piece includes a first rack gear meshed with the connection gear and a second rack gear meshed with the driven gear.

6. The image forming apparatus according to claim 5, wherein the gear train contains a movable gear movable between a first position where the movable gear connects the connection gear to the driving source and a second position where the movable gear disconnects the connection gear and the driving source.

7. The image forming apparatus according to claim 6, wherein the moving piece is made to be movable between the connection position and the release position by moving the movable gear to the second position.

8. The image forming apparatus according to claim 6, wherein the connection mechanism further includes a biasing body biasing the movable gear to the first position.

9. The image forming apparatus according to claim 1, wherein the toner container further includes an operation member connected to the shutter, the operation member is rotatable between a first operation position and a second operation position, and when the operation member is rotated between the first operation position and the second operation position in a state where the connection mechanism disconnects the driving source and the shutter, a rotation of the operation member is transmitted to the shutter, and the shutter is rotated between the close position and the open position.

10. The image forming apparatus according to claim 1, further comprising a conveyance member conveying the toner discharged through the toner discharge port, wherein the conveyance member is connected to the connection mechanism, and when the driving source is driven, the driving force of the driving source is transmitted to the conveyance member via the connection mechanism, and the conveyance member is rotated.

11. The image forming apparatus according to claim 1, further comprising:

an image carrier carrying a toner image;

an intermediate transferring belt to which the toner image is transferred from the image carrier; and a driving roller which rotates the intermediate transferring belt, wherein when the driving source is driven, the driving force of the driving source is transmitted to the driving roller via the connection mechanism, and the driving roller is rotated.

12. An image forming apparatus comprising:

a toner container containing a toner; and an apparatus main body to which the toner container is attached in a detachable manner, wherein the toner container includes:

a container main body having a toner discharge port; and a shutter rotatable between a close position where the shutter closes the toner discharge port and an open position where the shutter opens the toner discharge port, the apparatus main body includes:

a driving source;

a connection mechanism connectable the driving source to the shutter; and a conveyance member connected to the connection mechanism and conveying the toner discharged through the toner discharge port, wherein when the driving source is driven in a state where the connection mechanism connects the driving source to the shutter, a driving force of the driving source is transmitted to the shutter via the connection mechanism and then the shutter is rotated from the close position to the open position, and the driving force of the driving source is transmitted to the conveyance member via the connection mechanism and then the conveyance member is rotated.

13. An image forming apparatus comprising:

a toner container containing a toner; and an apparatus main body to which the toner container is attached in a detachable manner, wherein the toner container includes:

a container main body having a toner discharge port; and a shutter rotatable between a close position where the shutter closes the toner discharge port and an open position where the shutter opens the toner discharge port, the apparatus main body includes:

a driving source;

a connection mechanism connectable the driving source to the shutter;

an image carrier carrying a toner image;

an intermediate transferring belt to which the toner image is transferred from the image carrier; and a driving roller which rotates the intermediate transferring belt, wherein when the driving source is driven in a state where the connection mechanism connects the driving source to the shutter, a driving force of the driving source is transmitted to the shutter via the connection mechanism and then the shutter is rotated from the close position to the open position, and the driving force of the driving source is transmitted to the driving roller via the connection mechanism and then the driving roller is rotated.

* * * * *